US007234772B2

(12) United States Patent
Wells

(10) Patent No.: US 7,234,772 B2
(45) Date of Patent: Jun. 26, 2007

(54) ARTICULATED SEATING MECHANISM

(76) Inventor: Harold G. Wells, 4600 Asbury Church Rd., Lincolnton, NC (US) 28092

( * ) Notice: Subject to any disclaimer, the term of this patent is extended or adjusted under 35 U.S.C. 154(b) by 591 days.

(21) Appl. No.: 10/817,584

(22) Filed: Apr. 2, 2004

(65) Prior Publication Data

US 2004/0195881 A1 Oct. 7, 2004

Related U.S. Application Data

(60) Provisional application No. 60/459,889, filed on Apr. 2, 2003.

(51) Int. Cl.
*A47C 3/027* (2006.01)

(52) U.S. Cl. ..... 297/262.1; 297/270.1; 297/270.4; 297/313; 297/316

(58) Field of Classification Search ..... 297/262.1, 297/270.1, 270.2, 270.3, 270.4, 313, 316, 297/317, 322, 337
See application file for complete search history.

(56) References Cited

U.S. PATENT DOCUMENTS

| | | | | |
|---|---|---|---|---|
| 20,863 | A | 7/1858 | Carrier | |
| 273,630 | A | 3/1883 | Stevens | |
| 317,933 | A | 5/1885 | Doubler | |
| 346,311 | A * | 7/1886 | Parry | 297/262.1 |
| 834,670 | A * | 10/1906 | Hartzler | 297/262.1 |
| 1,555,689 | A | 9/1925 | Miller | |
| 1,840,679 | A * | 1/1932 | Schauss | 297/262.1 |
| 3,446,532 | A | 5/1969 | Cramer | |
| 3,712,666 | A | 1/1973 | Stoll | |
| 4,451,085 | A | 5/1984 | Franck et al. | |
| 4,979,778 | A | 12/1990 | Shields | |
| 5,048,893 | A | 9/1991 | Cowan | |
| 5,137,333 | A | 8/1992 | Chee | |
| 5,603,551 | A | 2/1997 | Sheehan | |
| 5,716,099 | A | 2/1998 | McDiarmid | |
| 5,810,440 | A | 9/1998 | Unwalla | |
| 5,826,940 | A | 10/1998 | Hodgdon | |
| 6,000,755 | A | 12/1999 | Uhlenbrock | |
| 6,109,694 | A | 8/2000 | Kurtz | |

FOREIGN PATENT DOCUMENTS

DE 3439917 C1 * 8/1985

* cited by examiner

*Primary Examiner*—Anthony D. Barfield
(74) *Attorney, Agent, or Firm*—Craig M. Stainbrook; Stainbrook & Stainbrook, LLP

(57) ABSTRACT

An articulated seating mechanism including a rocker base, a seat plate, and a pair of side rails, each having an arcuate side. The side rails may be disposed downwardly from the seat plate or upwardly from the rocker base. First and second arcuate gear portions are disposed on the arcuate side of each of the side rails and a first and second substantially flat or linear gear racks are affixed either to the underside of the seat plate or the upper side of the rocker base, so as to bring the linear gears and the arcuate gears into intermeshing relationship. A back support is pivotally connected to the seat plate and to first and second back links, and the back links are pivotally connected to the rocker base to provide a rocking motion of the seat plate and a dynamic synchronous adjustment of the angular variation between the seat plate and the back support. The linear gear racks move in a tangent to the arcuate gear portions to provide a moving fulcrum during rocking movements. No springs or other force means are necessary to assist in moving easily from a reclined position to task.

18 Claims, 14 Drawing Sheets

ARTICULATED SEATING MECHANISM

CROSS REFERENCE TO RELATED APPLICATIONS

The present application claims the benefit of the filing date of U.S. Provisional Patent Application, Ser. No. 60/459,889, filed Apr. 2, 2003.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to adjustable chairs, more particularly to an articulated rocking mechanism for a tilting ergonomic chair.

BACKGROUND INFORMATION AND DISCUSSION OF RELATED ART

Adjustable chairs are well known in the art. In fact, adjustable office seating has now reached a high level of sophistication and maturity. Elements of contemporary ergonomic chairs have been in use for centuries and technological developments can be seen as early as the late $19^{th}$ century when, for example, innovators focused on improving the back and forth rocking movement possible in chairs. Exemplary patents include U.S. Pat. No. 273,630 to Stevens, and U.S. Pat. No. 317,933 to Doubler. A more involved design is shown in U.S. Pat. No. 1,555,689 to Miller, and early ergonomic rocking designs are seen in U.S. Pat. No. 5,603,551 to Sheehand, and U.S. Pat. No. 5,048,893 to Cowan et al.

Efforts at developing a more practical back and forth tilting action were focused largely on office chairs, in which hinged and tilting seat posts were provided. Illustrative examples of the evolving apparatus are shown in U.S. Pat. No. 3,446,532 to Cramer; U.S. Pat. No. 3,712,666 to Stoll; U.S. Pat. No. 4,979,778 to Shields; and U.S. Pat. No. 5,716,099 to McDiarmid. These patents show increasingly elegant designs for a hinged seat post.

A more challenging aspect in developing truly ergonomic chairs has been in synchronizing, coordinating, and integrating back rest movement with seat plate movement without sacrificing comfort or allowing for dangerous or otherwise awkward seating positions. However, this feature, too, has undergone considerable development in recent years, as illustrated in the following: U.S. Pat. No. 4,451,085 to Franck et al; U.S. Pat. No. 5,810,440 to Unwalla; U.S. Pat. No. 5,826,940 to Hodgdon; U.S. Pat. No. 6,000,755 to Uhlenbrock; and U.S. Pat. No. 6,109,694 to Kurtz.

As an appreciation of the need to provide workers with an ergonomically advantageous workplace has increased, office seating technology has advanced considerably. The past five years has seen a number of significant advances in ergonomic seating that integrates a number of static elements, adjustment features, and dynamic synchronous movement. Those most relevant to a consideration of the present invention are shown in the following references:

U.S. Pat. No. 6,086,153, to Heidmann et al, which discloses a chair, which includes a base assembly with a control housing having opposing side flanges and a side pivot, a back pivoted to the base assembly for movement between upright and reclined positions, and a seat operably supported on the base assembly and connected to the back for coordinated synchronous movement with the back. An energy mechanism biases the back toward the upright position. The energy mechanism includes an extendable/compressible spring positioned transversely in the control housing with one end supported on one of the side flanges, and further includes a lever pivoted to the side pivot and having a spring-engaging portion engaging a free end of the spring and also having a seat-biasing portion operably connected to the seat. The side pivot, the spring-engaging portion, and the seat-biasing portion are spaced from each other and arranged so that the spring biases the lever about a fulcrum located generally at the side pivot to bias the back toward the upright position.

U.S. Pat. No. 6,386,634 to Stumpf et al., teaches an office chair having a seat, a back and a pair of armrests. In its primary aspects, the chair includes a linkage assembly that allows the seat and back to tilt downwardly and rearwardly and to allow pivotal movement of the seat about a pivot axis in substantial alignment with the hip joints of a user. This is intended to inhibit shear forces from pulling the clothing on the body of a user. The linkage assembly may also adapted to allow the seat and back to tilt downwardly and rearwardly such that the seat pivots about an effective pivot point at substantially the ankle of a user having feet resting on a floor.

U.S. patent application Ser. No. 2003/0001420 by Koepke et al., teaches an ergonomic chair that purportedly incorporates synchronous tilt of back and seat; tilt limit control; separate seat adjustment; arm adjustment; adjustable lumbar support; cushion airflow; mesh attachment and modular base frame assembly. The chair comprises a four bar linkage system causing the seat rear to elevate as the back is reclined. A tilt limit restricts the degree of chair back tilt to a predetermined reclined position with manual movement of a lever. Horizontal positioning of the chair seat cushion is accomplished with a positive locking device. Height and pivot adjustable chair arms are actuated with buttons or rotation. A height adjustable lumbar support is provided, with adjustments requiring no screws or adjustment knobs and without the need of direct contact of the lumbar support with the back of the user.

U.S. Pat. No. 6,698,833 to Ball et al., describes an adjustable office chair with a base having a control assembly operably supporting a seat assembly and also a back assembly for movement about a seat tilt axis and a back tilt axis, respectively. The back assembly includes a flexible sheet hung tightly and hanging down from the upper corners of the back support structure. The lower portion of the flexible sheet is coupled to the back support structure by a tensioner for holding the lower portion rearwardly. A vertically adjustable lumbar mechanism is supported on the back support structure and biases an intermediate portion of the flexible sheet forwardly to both form the intermediate portion into a forwardly convex shape for postural lumbar support and also to tension the flexible sheet.

U.S. patent application Ser. No. 2002/0149247 by Diffrient, discloses an occupant-weight-operated chair having a seat and a back mounted upon support structure, such as a caster-mounted pedestal. The back reclines relative to the seat, and the structure of the chair, and the relationship of the components, is such that as the back is reclined the entire seat raises against the weight of the occupant. Accordingly, the occupant's weight loads the chair mechanism, and the force required to recline the back is substantially uniform throughout the back-reclining range of movement. The back of the chair is attached to the rear of the seat region so that reclining the back raises the elevation of the seat rear region against the occupant's weight. The combination of the upward movement of the chair seat in conjunction with the reclining rotation of the chair back simulates the movement of the user's torso about the user's hip joint as the user reclines.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

BRIEF SUMMARY OF THE INVENTION

It is an object of the present invention to provide an adjustable ergonomic seat, and more particularly, an articulated rocking mechanism by which a separate caster base member, a seat, a back and optional arm rests can be attached to produce a completed tilting ergonomic chair. A chair incorporating the inventive apparatus provides a user means to move from a reclining position to a task-oriented position with a synchronous seat-to-back motion ratio of approximately 1:2. It makes use of a tilt mechanism having a moving fulcrum and allows a user to adjust both a preferred relaxation point and a range of motion.

Another object of the present invention is to provide a seating mechanism that integrates the seat and back to impart a predetermined synchronous movement that requires no external energy control sources such as springs to counteract the changing gravitational forces acting on a reclining user.

A further object of the inventive apparatus is to provide a seating mechanism with a self-balancing feature that accommodates a large range of movement and that also allows the user a continuous angular variation regardless of the user's size or body weight.

A still further object of the present invention is to provide an articulated seating mechanism with a rocker mechanism that allows the user to move freely between an upright open posture to a full reclining posture by initiating changes in the body's center of gravity, such initiations ranging from direct opposing forces applied to the floor with the feet to balance shifts by moving the torso in relation to the hips.

Yet another object of the present invention is to provide an articulated seating mechanism whereby body movements as subtle as changing foot location or head position are sufficient to elicit dynamic micro-adjustments in the seating configuration.

A still further object of the present invention is to provide a progressively opening seat-to-back angle that is dynamically activated by a linkage between the rocking portion of the mechanism and the vertical back support member, wherein the seat-to-back angular variation increases as the user reclines and decreases as the user sits forward to work in a task-oriented position.

Yet another object of the present invention is to provide an articulated seating mechanism with which the user has the option, with minimal control device input, to bias dynamic synchronous movements between an upright and full reclining posture while maintaining the ability to override preset adjustments with intentional body placement.

Another object of the present invention is to provide a seating mechanism having independent vertical and angular lumbar adjustments, plus a dynamically operated downwardly tilting front portion of the seat portion to provide a gentle release of pressure under the user's thigh which is introduced by the raised front edge of the seat while reclining.

All of the elements necessary to embody the inventive concept can be manufactured by any of a number of standard methods such as die casting, sand casting, tool and die forming, aluminum extrusion and injection molding, but alternative manufacturing processes are also contemplated.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein.

DRAWING REFERENCE NUMERALS

Figure 1:
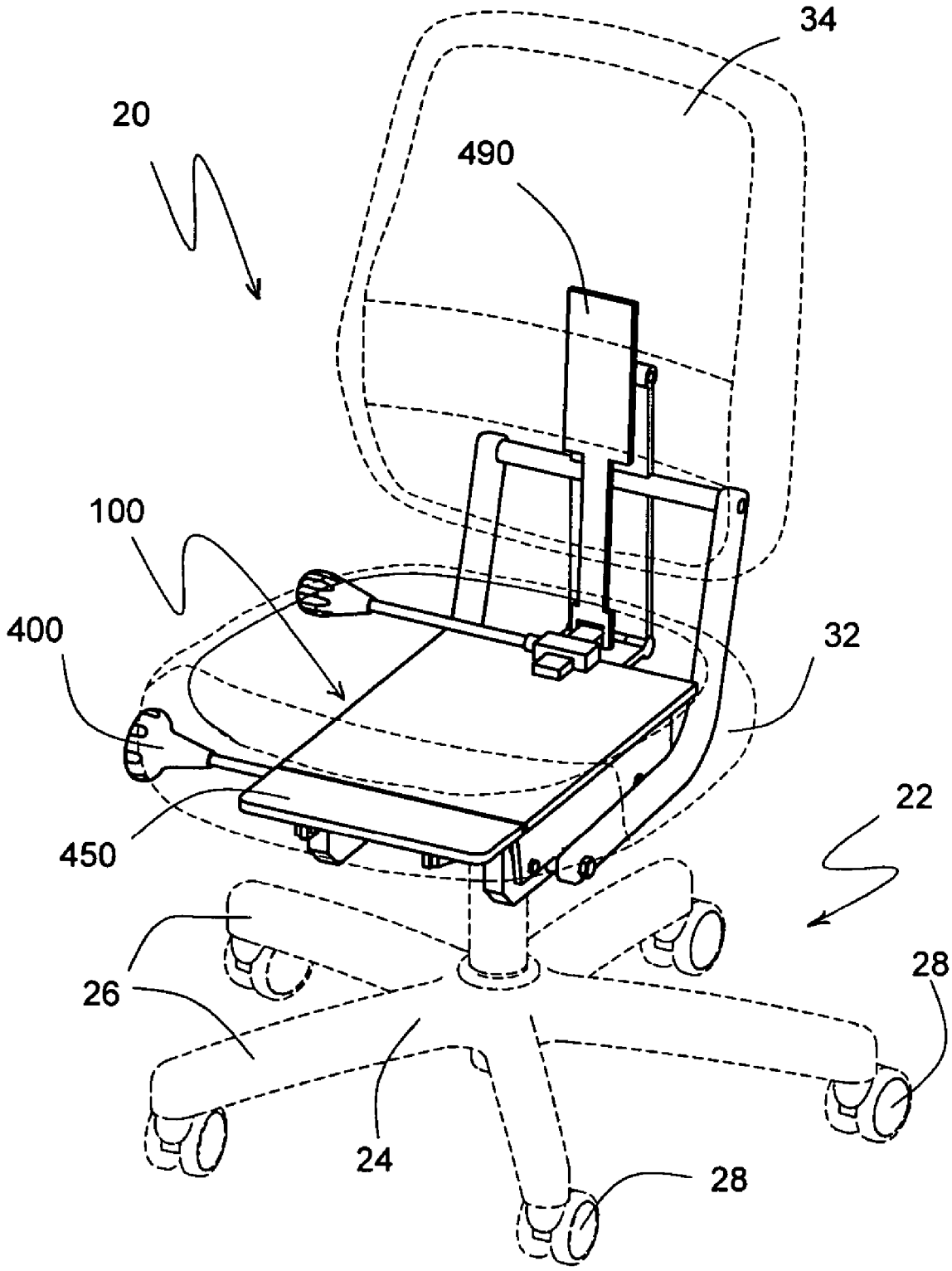
FIG. 1 is an upper left front perspective view of an ergonomic chair embodying the articulated seating mechanism of the present invention.

20 office chair
22 pedestal
24 caster base
26 base legs
28 casters
30 telescoping extendable center post
32 seat cushion
34 back cushion
100 first preferred embodiment of articulated seating mechanism, generally
110 planar rocker base
120*a* right rail
120*b* left rail
130*a* underside of right rail
130*b* underside of left rail
140*a* arcuate top side of right rail
140*b* arcuate top side of left rail
150*a* front side of right rail
150*b* front side of left rail
160*a* rear side of right rail
160*b* rear side of left rail
170*a* width of right rail
170*b* width of left rail
172*a* interior side of right rail
172*b* interior side of left rail
174*a* exterior side of right rail
174*b* exterior side of left rail
176*a* front arcuate slot of right rail
176*b* front arcuate slot of left rail
180*a* apex of right rail
180*b* apex of left rail
190*a* right rail arcuate gear portion
190*b* left rail arcuate gear portion
200 seat plate
200*a* right side of seat plate
200*b* left side of seat plate
200*c* front side of seat plate
200*d* rear side of seat plate
200*e* top side of seat plate
200*f* underside of seat plate
210*a* right linear gear rack
210*b* left linear gear rack
220*a* right proximity plate
220*b* left proximity plate
222*a* right front containment pin
222*b* left front containment pin
224*a* right rear containment pin
224*b* left rear containment pin
230 hub
F moving fulcrum
240 back support
250 back slide plate
250*a* rear portion of back slide plate
250*b* front portion of back slide plate
260 hinge
270*a* right slide rail
270*b* left slide rail
280*a* right back link
280*b* left back link
290*a* right pivot point
290*b* left pivot point
300 transverse bar
310*a* right (transverse bar) point
310*b* left (transverse bar) pivot point
320 angle rod
330 rod guide
340*a* rod lock
340*b* rod lock
350 rod lock pivot point
360 compression spring
370 release cable
380 release sleeve
385 collar
390 release sleeve connection point
400 bias control knob
410 pinion gear
420 idler gear
430*a* right bracket
430*b* left bracket
440 gear rack
450 seat flap
460*a* right connector link
460*b* left connector link
470*a* right (connector link) bracket
470*b* left (connector link) bracket
480*a* right connection point
480*b* left connection point
490 back strut
500 hinge

510 back strut prongs
520 bar
530 pinion gear/tension roller housing
540 back strut adjustment knob
550 thumb flange
560 height adjustment sleeve
570 linkage
580 extendable column release button
600 second preferred embodiment of articulated seating mechanism of the present invention, generally
610 arcuate gear rack
620 linear gear rack
630 arcuate underside of rails
640 rails
650 linear gear rack
660 upper surface of rocker base
670 rocker base
680 seat plate
690 adjustable back support
700 back links
710 seat flap

DETAILED DESCRIPTION OF THE INVENTION

Figure 2:
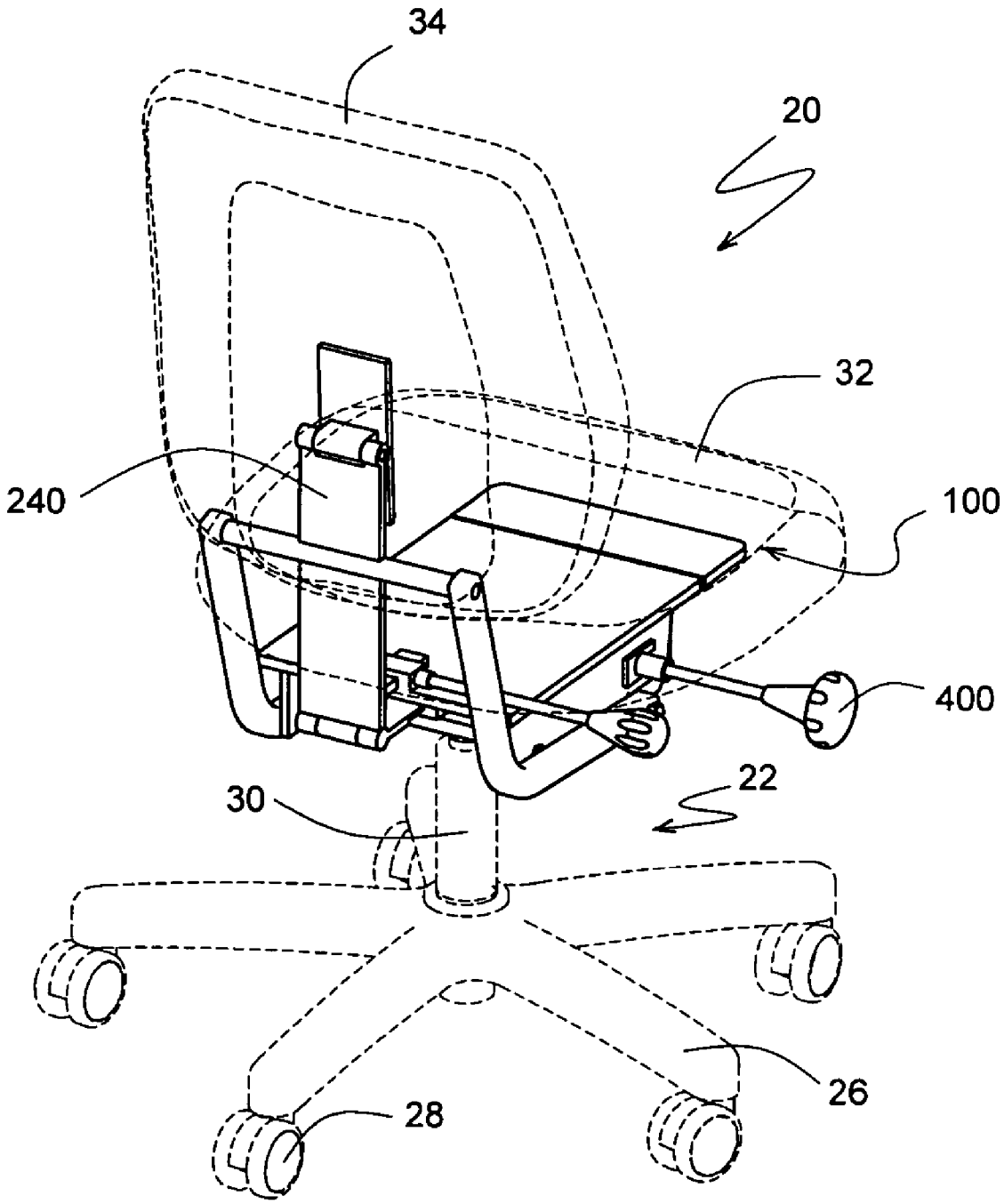
FIG. 2 is an upper right rear perspective view of the chair shown in FIG. 1.
Figure 3:
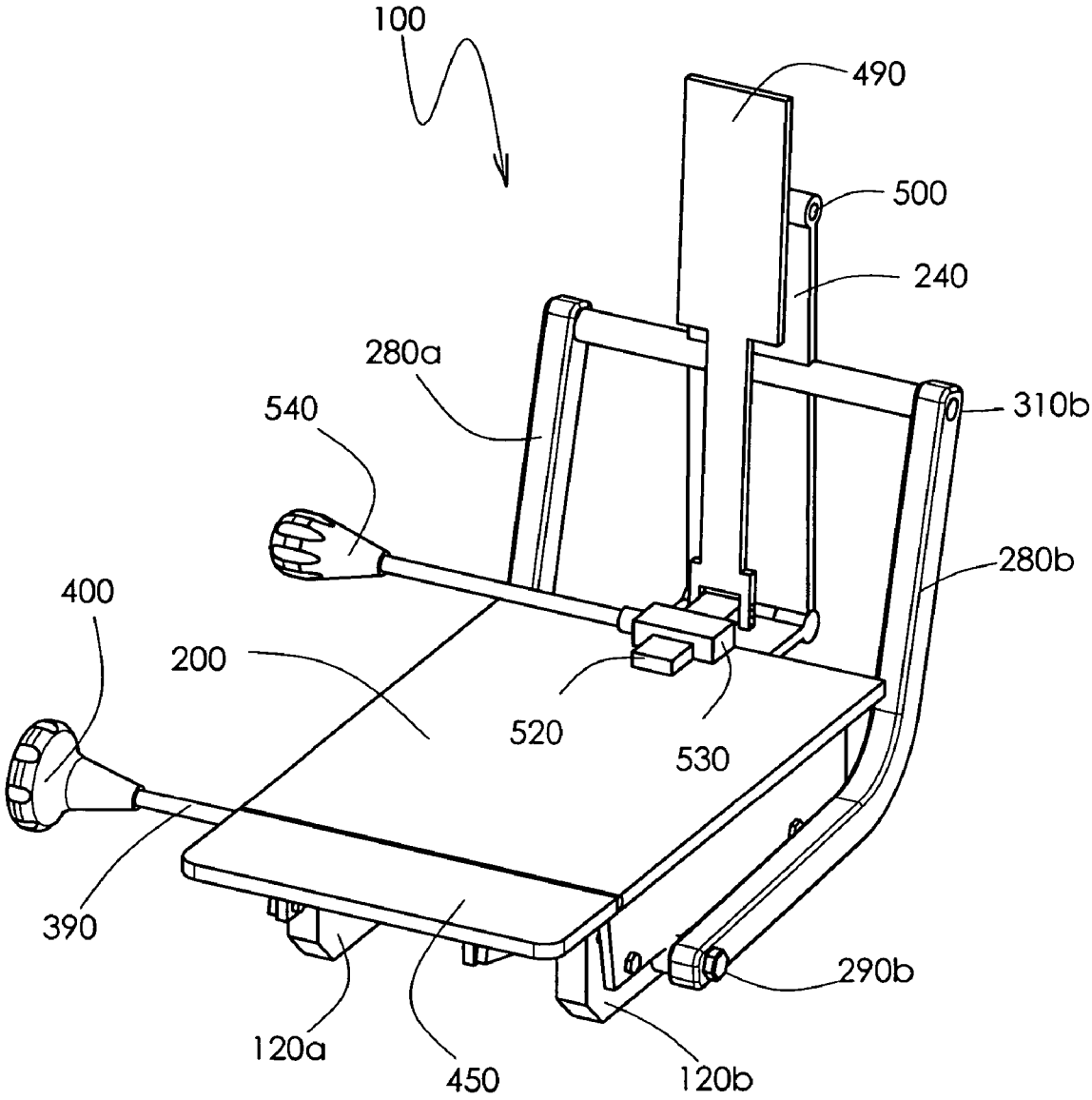
FIG. 3 is an upper front left perspective view of the seating mechanism of the present invention.
Figure 4:
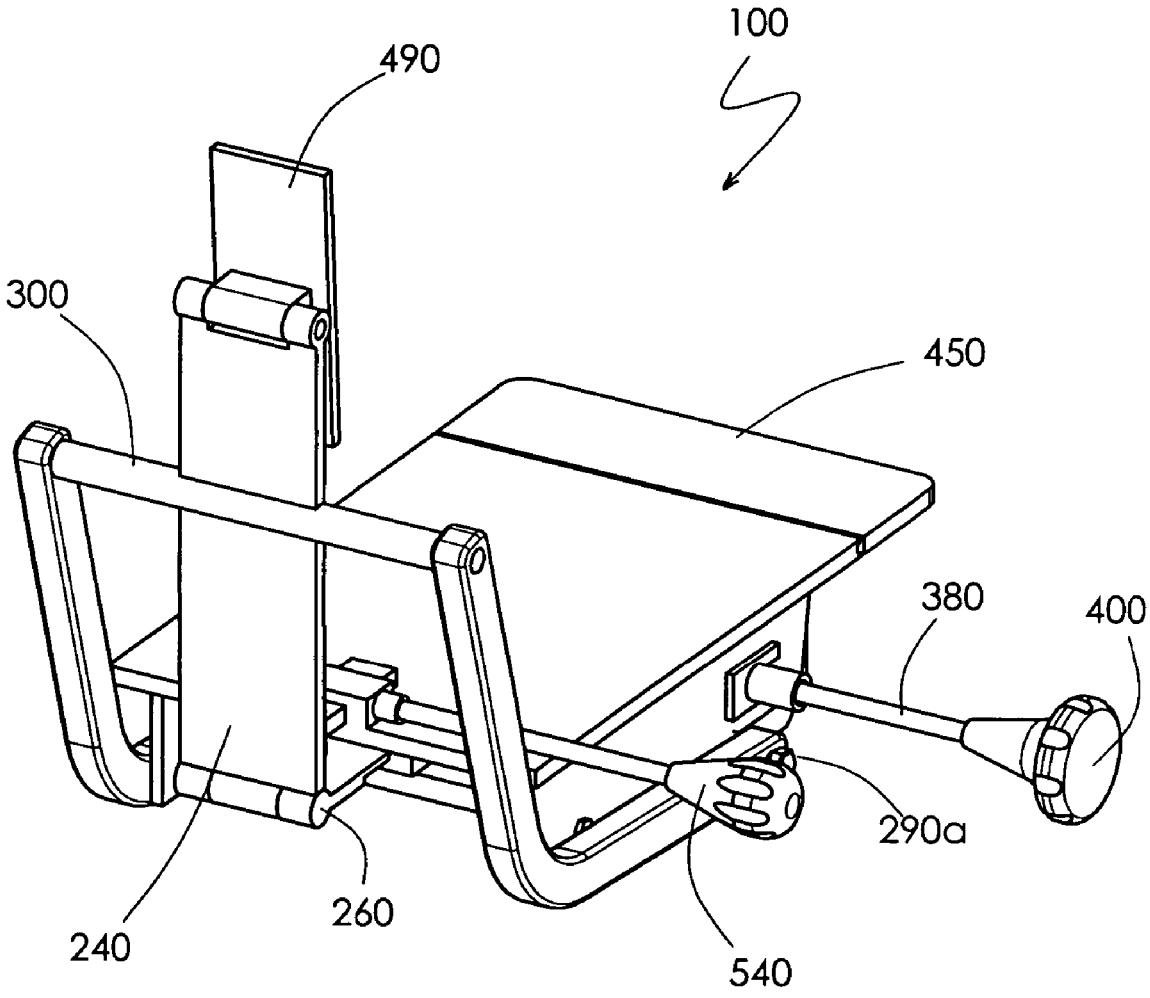
FIG. 4 is an upper rear right upper perspective view of the seating mechanism shown in FIG. 3.
Figure 5:
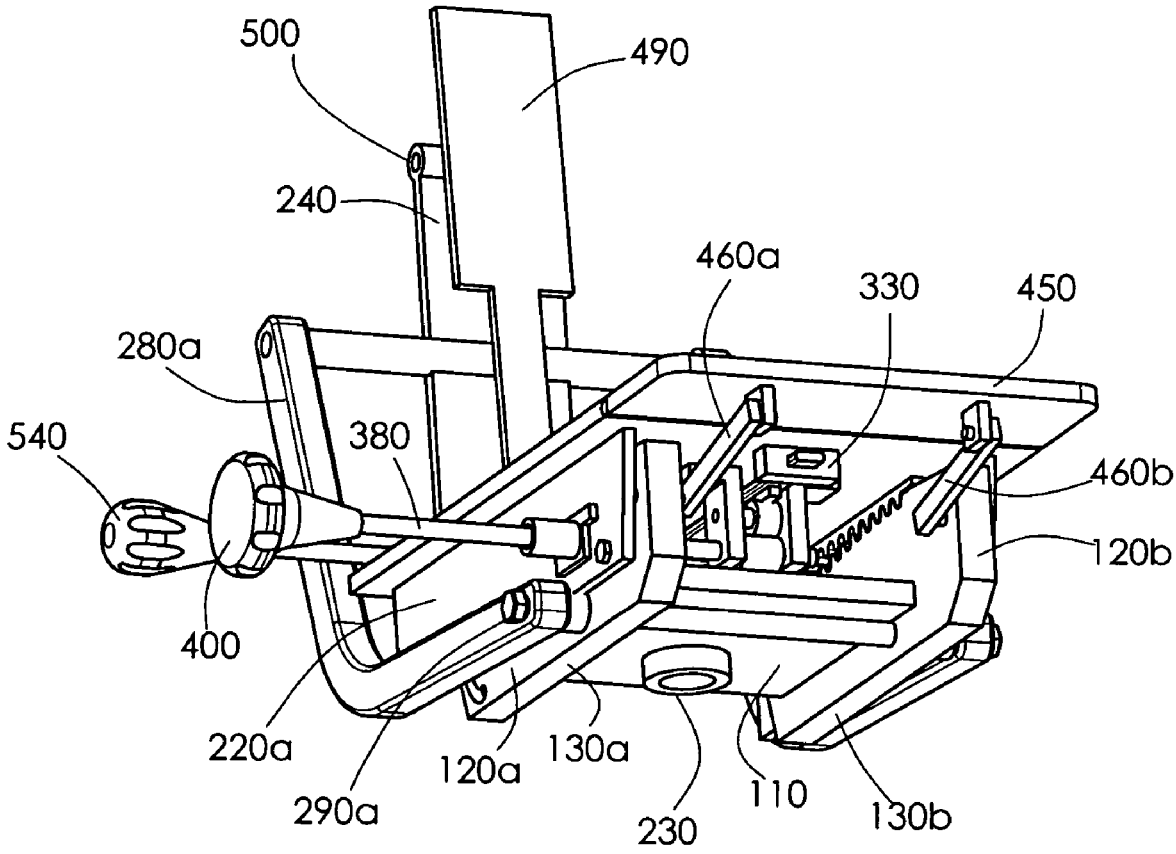
FIG. 5 is a lower front right perspective view of the seating mechanism.
Figure 6:
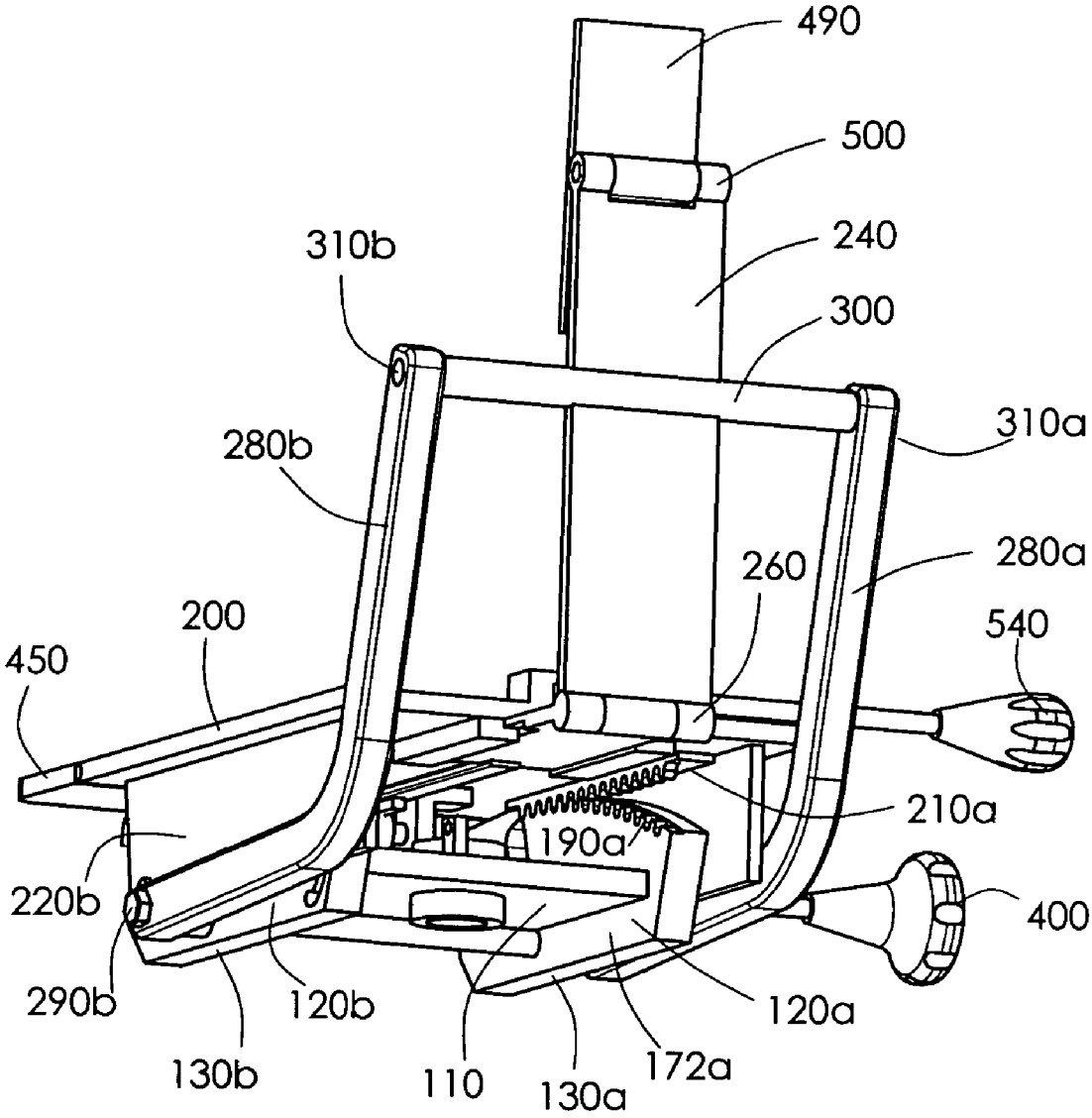
FIG. 6 is a lower rear left perspective view of the seating mechanism.
Figure 7:
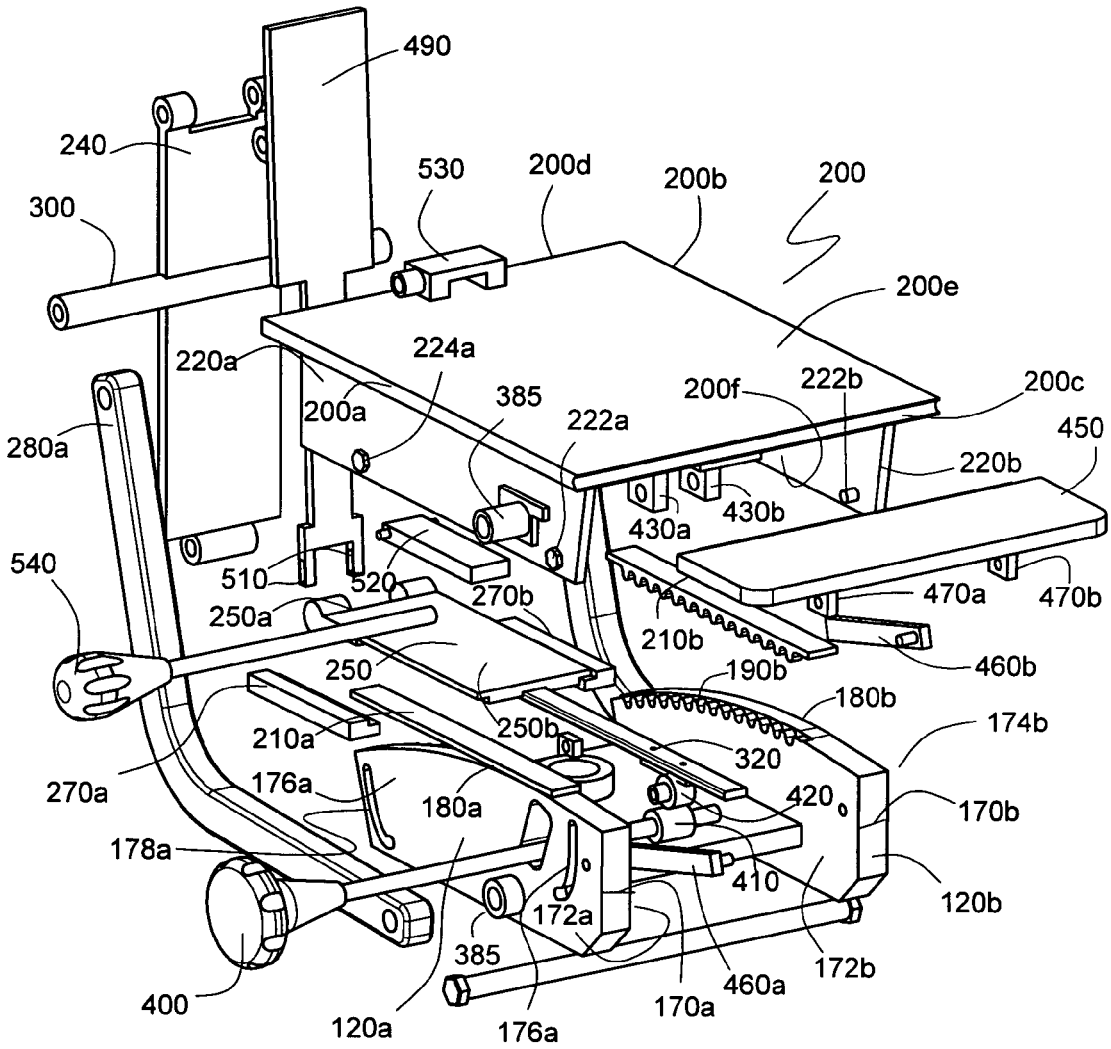
FIG. 7 is an exploded upper front right perspective view of the inventive articulated seating mechanism.

Referring to FIGS. 1 through 12, wherein like reference numerals refer to like components in the various views, there is illustrated therein a new and improved articulated seating mechanism, the first preferred embodiment of which is generally denominated 100 herein. FIG. 1 is an upper left front perspective view of an ergonomic chair incorporating the articulated seating mechanism of the present invention, while FIG. 2 is an upper right rear perspective view thereof. In these views the inventive seating mechanism is shown incorporated into an office chair 20. As with most office chairs currently available, the chair shown includes a pedestal 22 having a caster base 24 with a plurality of legs 26 and corresponding casters 28. The pedestal includes a telescoping extendable center post 30 on which the seating portion of the chair is supported. The chair also includes a seat cushion 32 and back cushion 34. These conventional features are shown in dashed lines and show a primary possible implementation; they do not comprise elements of the present invention. The inventive seating mechanism, shown in solid lines, along with the caster base, seat cushion, and back cushion shown in dashed lines, represent a complete ergonomic chair.

An office chair as shown, incorporating the inventive seating mechanism, includes all of the components necessary to produce: (1) a rocking motion; (2) a reclining angular variation; (3) independent vertical adjustments; and (4) a dynamically downwardly tilting front seat edge, responsive to the rocking motion such that the further the chair is rocked backward, the more the front seat edge hinges and tilts downwardly.

Figure 8:
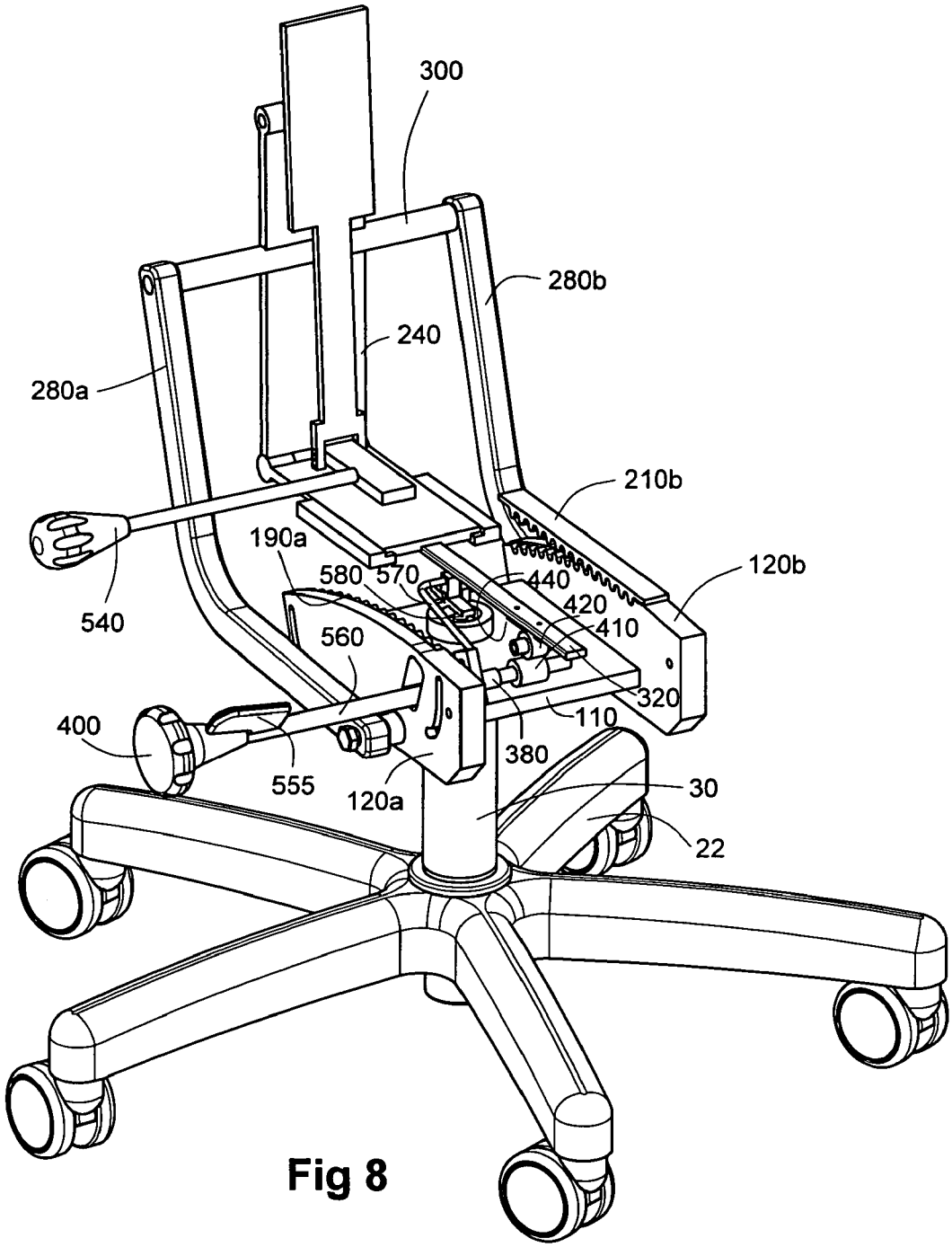
FIG. 8 is a perspective view of the inventive apparatus integrated into a office chair support structure, shown with the seat plate, seat cushion, and back cushion removed.

FIGS. 3-8 comprise a variety of views of the articulated seating mechanism of the present invention, as implemented in an assembly adapted for support on an office chair having a pedestal base. All of the elements necessary for such an implementation are shown. FIG. 8 is a perspective view showing selected elements mounted on a pedestal chair, with the cushions and seat plate removed. Collectively, these views show that the inventive apparatus includes a generally planar rocker base 110 bounded on a first side by a right rail 120*a*, and on a second side by a left rail 120*b*. In the first preferred embodiment, each of the right and left rails, respectively, has a substantially flat underside, 130*a*, 130*b*, an arcuate top side 140*a*, 140*b*, a front side 150*a*, 150*b*, a rear side 160*a*, 160*b*, a width 170*a*, 170*b*, an interior side 172*a*, 172*b*, and an exterior side 174*a*, 174*b*. Each rail further includes front arcuate slots 176*a*, 176*b* (latter, see FIGS. 9-10 only), and rear arcuate slots 178*a*, 178*b* (latter, see FIGS. 9-10). The arcuate top sides include an apex 180*a*, 180*b*, or uppermost point, back from which a rear portion arcs gently downwardly toward the rear side of the rail, and from which a front portion curves gently downwardly toward the front side of the rail.

Each of the right and left rails further includes an arcuate gear portion 190*a*, 190*b*, spanning substantially the entire top side of the rail, but spanning at least the rear portion of the top side from the apex to a point proximate the rear side, and preferably at least a few gear teeth forward from the apex toward the front side of the rail. The arcuate gear portion is roughly one half the width of the rail.

A seat plate 200 is disposed on the top sides of the right and left rails. The seat plate includes a right side 200*a*, a left side 200*b*, a front side 200*c*, a rear side 200*d*, a top side 200*e*, and an underside 200*f*. Right and left linear, or substantially flat, gear racks 210*a*, 210*b* are affixed to the right and left portions of the underside of the seat plate so as to mate and intermesh with the arcuate gear portions 190*a*, 190*b*, on the top sides of right and left rails 120*a*, 120*b*. By these means the seat plate is prevented from sliding longitudinally (backwards and forwards) over the top sides of the rails.

Lateral movement of the seat plate is prevented by right and left proximity plates, 220*a*, 220*b*, which are integral with the underside 200*f* of seat plate or otherwise affixed thereto, and which secure the seat plate over the arcuate gear portion of the rails. The proximity plates each include front and rear selectively removable pins, numbered, respectively, 222*a*, and 222*b* for the front, and 224*a*, and 224*b*, for the rear, which are inserted into the front and rear slots 176*a-b*, 178*a-b*, of rails 120*a*, 120*b*. The pins further secure the seat plate and prevent an excessive range of rocking movement beyond that allowed by the slots.

The underside of the seat plate also includes a hub 230 for a swiveling connection to the telescoping extendable portion of center post 30 of the chair pedestal. Accordingly, the only movement the seat plate is capable of making is rotation about its lateral axis and a rocking movement forward and back over the curved top side of the rails. This motion is best explained and is functionally similar to what is commonly known as a rocking chair and will be referred to through the rest of this description as the "rocking movement." Other than obvious design elements, the radical departure from conventional rocking derives from the fact that in the preferred embodiment, the "floor" on which the rocking takes place is the top of the rails, and this floor is curved rather than the converse in conventional rockers.

During a rocking movement, the plane of the underside of the seat plate and the linear gear racks are a moving tangent or fulcrum F to the top side of the rails. It is this moving tangent point F that balances the user as he or she reclines. The moving tangent/fulcrum follows vertically under the user's center of gravity as that center of gravity is adjusted with body movements. This obviates the need for an additional energy mechanism to counter the changing gravitational forces associated with the reclining user. More specifically, no springs are needed to assist in bringing the chair from a reclined position to an upright position.

The seating mechanism further includes a back support 240 pivotally connected to the rear portion 250*a* of a back slide plate 250 at hinge 260. The front portion 250*b* of back slide 250 is adjustably attached to the underside 200*f* of seat plate 200 in opposing right and left slide rails 270*a*, 270*b*. The back slide is preferably substantially planar and lies in a plane substantially parallel to the plane of the underside of seat plate 200. However, it will be appreciated by those with skill in the art that back slide 250 could assume a different configuration and could comprise, for instance, a cylindrical rod adjustably connected to the underside of seat plate 200 with a rack and pinion gear assembly.

Right and left arcuate back links 280*a*, 280*b* are pivotally attached at a front end to right and left rails, respectively, at pivot points 290*a* 290*b*, and pivotally attached at their respective rear ends to the transverse bar 300 at pivot points 310*a*, 310*b*.

Referring once again the rocking motion described above, as a rearward rocking motion is initiated tangent point F moves rearward, and the angular variation between the seat plate and the back support increases. The back links effect this coordinated and synchronized adjustment. As the seat plate 200 tilts backward, the back links 280*a-b* impart a rotational movement to the back support 240 at hinge 260. The angular dimension of this rotation is greater than the angular dimensional variation between the seat plate and the rocker base. As the rocking movement progresses a synchronous movement is established and the seat-to-back angle increases. Synchronous movement of the seat and back effect an angle reduction in forward rocking motion.

Figure 9:
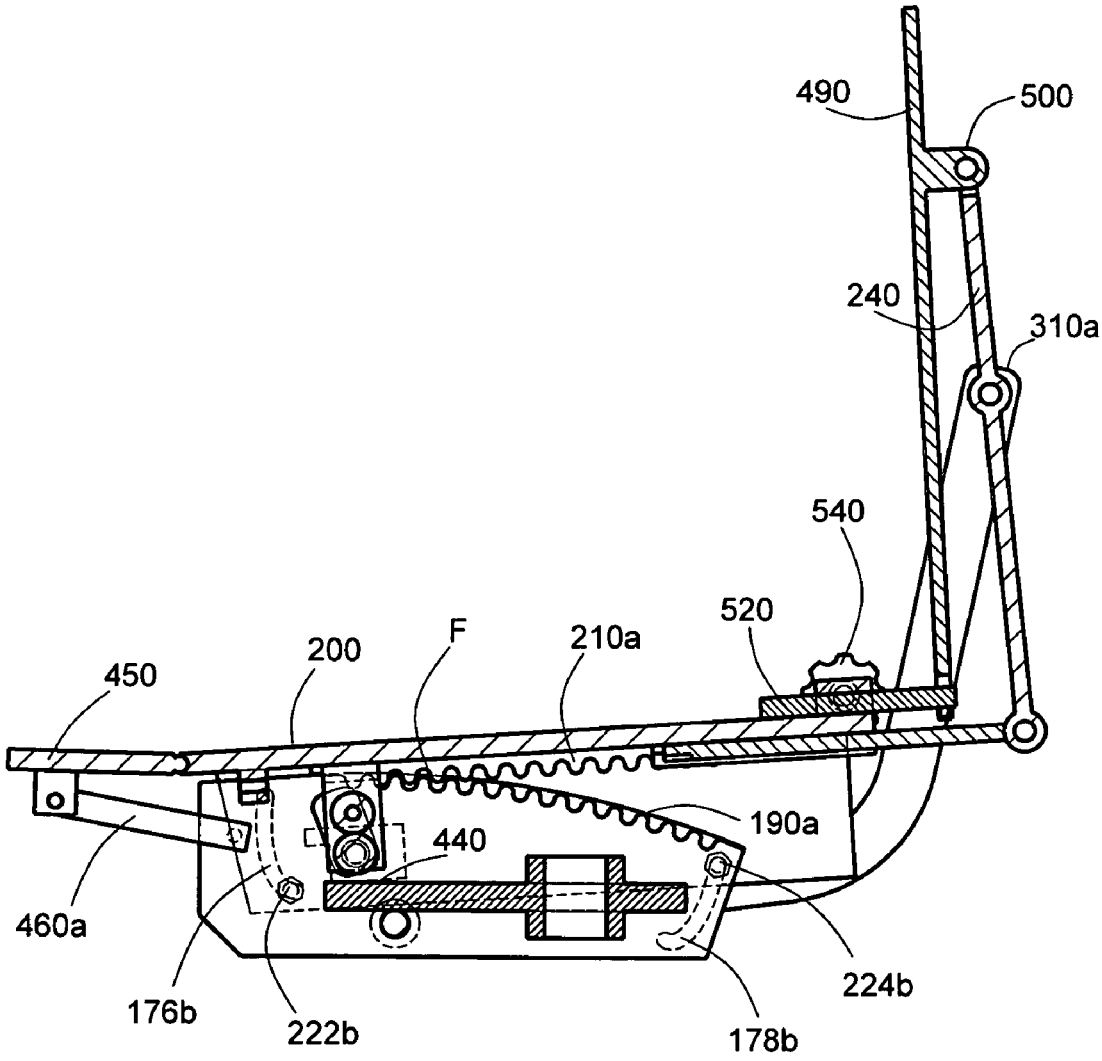
FIG. 9 is a cross-sectional left side view in elevation showing the seating mechanism in a slightly forward tilted position.
Figure 10:
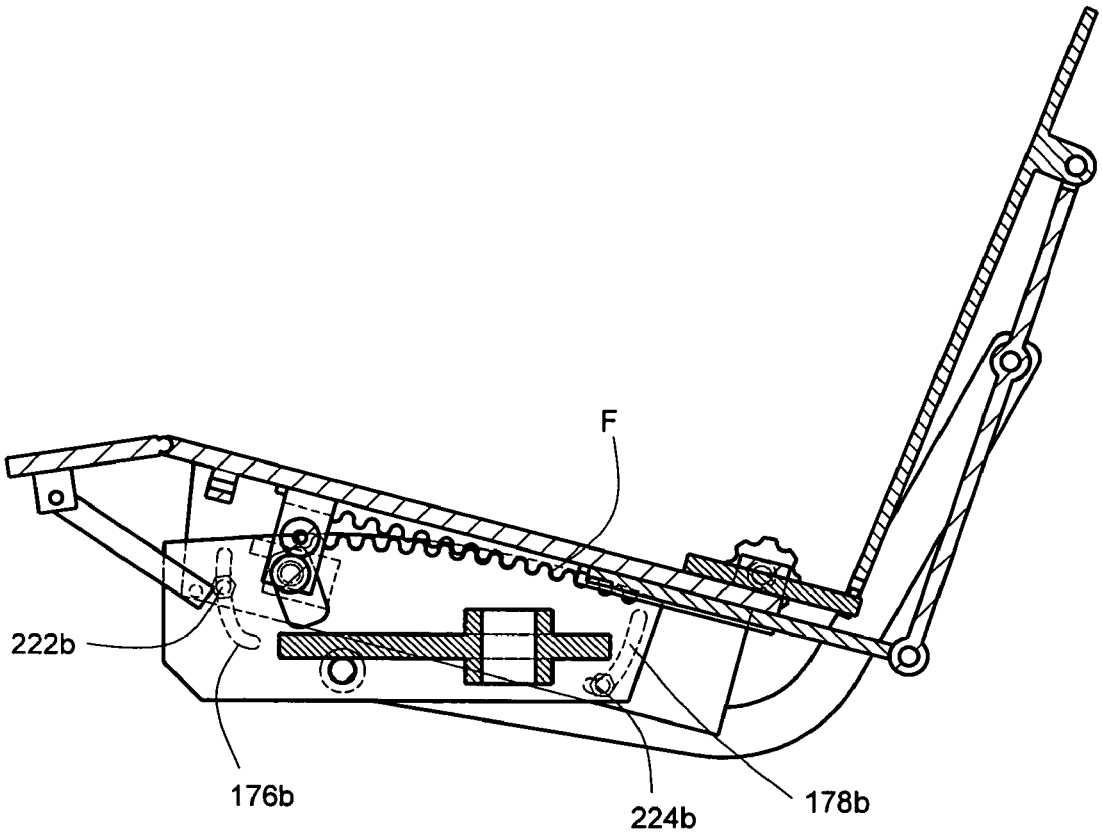
FIG. 10 is a cross-sectional left side view in elevation showing the seating mechanism in a slightly rearward titled position.

The angle between the seat plate 200 and the rocker base 110 can be biased. A possible adjustment may be seen in FIGS. 9 and 10, wherein. FIG. 9 illustrates a generally upright seating position and FIG. 10 illustrates a slightly reclined position or setting. The control bias is accomplished by adjusting the back slide 250 to allow for a sliding motion in relation to the seat plate. As noted, the back slide is adjustably connected to the underside of the seat plate with a pair of slide rails 270*a*, 270*b*. The slide rails are affixed with suitable fastener hardware. An angle rod 320 is fastened at one end to the back slide 250 and captured at the other with a rod guide 330. A pair of rod locks 340*a*. 340*b* are pivotally fastened to the underside of the seat plate at pivot point 350. The rod locks each have a slotted opening that conforms to and accommodates the cross sectional profile of the angle rod 320, which is inserted through the rod lock slots. A compression spring 360 urges the rod locks apart to open at the spring end and together at the slotted end, thereby binding the angle rod in a manner similar to a conventional woodworking clamp. That is, as long as the compression spring is applying a force to the rod locks, the angle rod is prevented from sliding. This, in turn, restricts the back slide from the same movement and does not impart a rotational movement to transverse bar 300.

Figure 11:
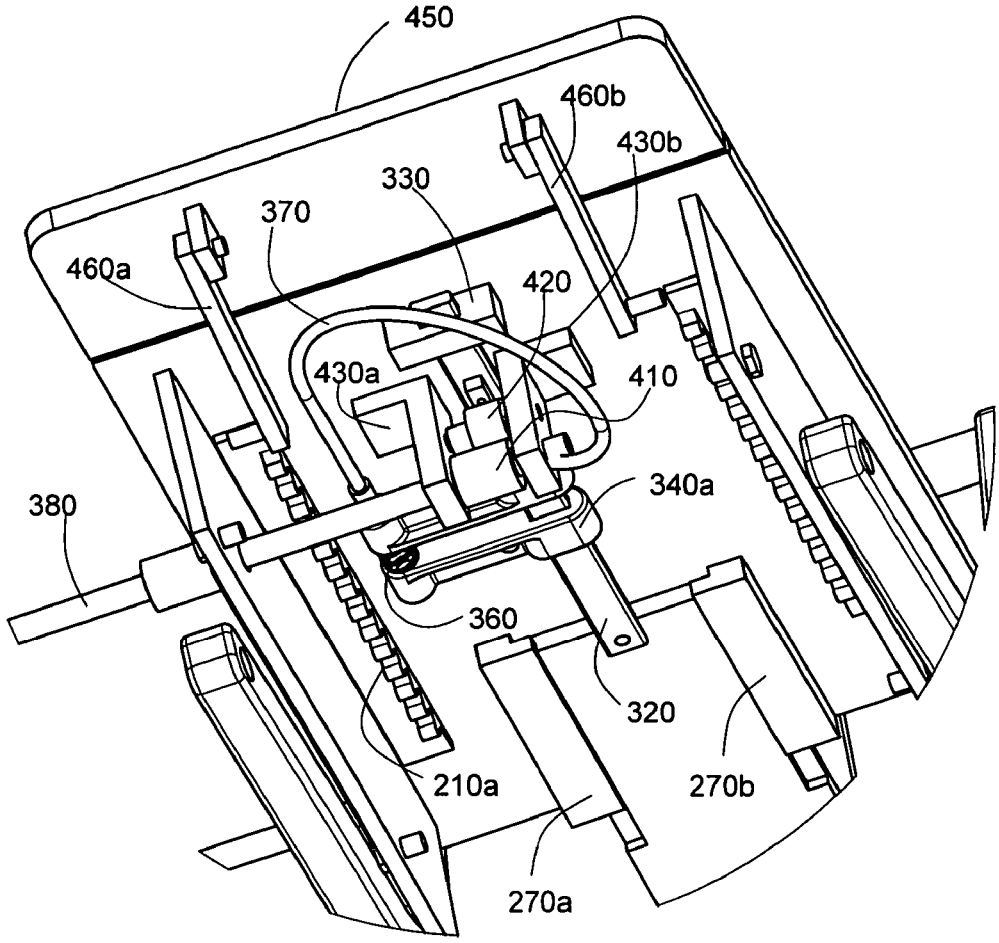
FIG. 11 is a lower left partial perspective view showing details of the front of the control mechanism to bias the angular variation of the seating mechanism.
Figure 12:
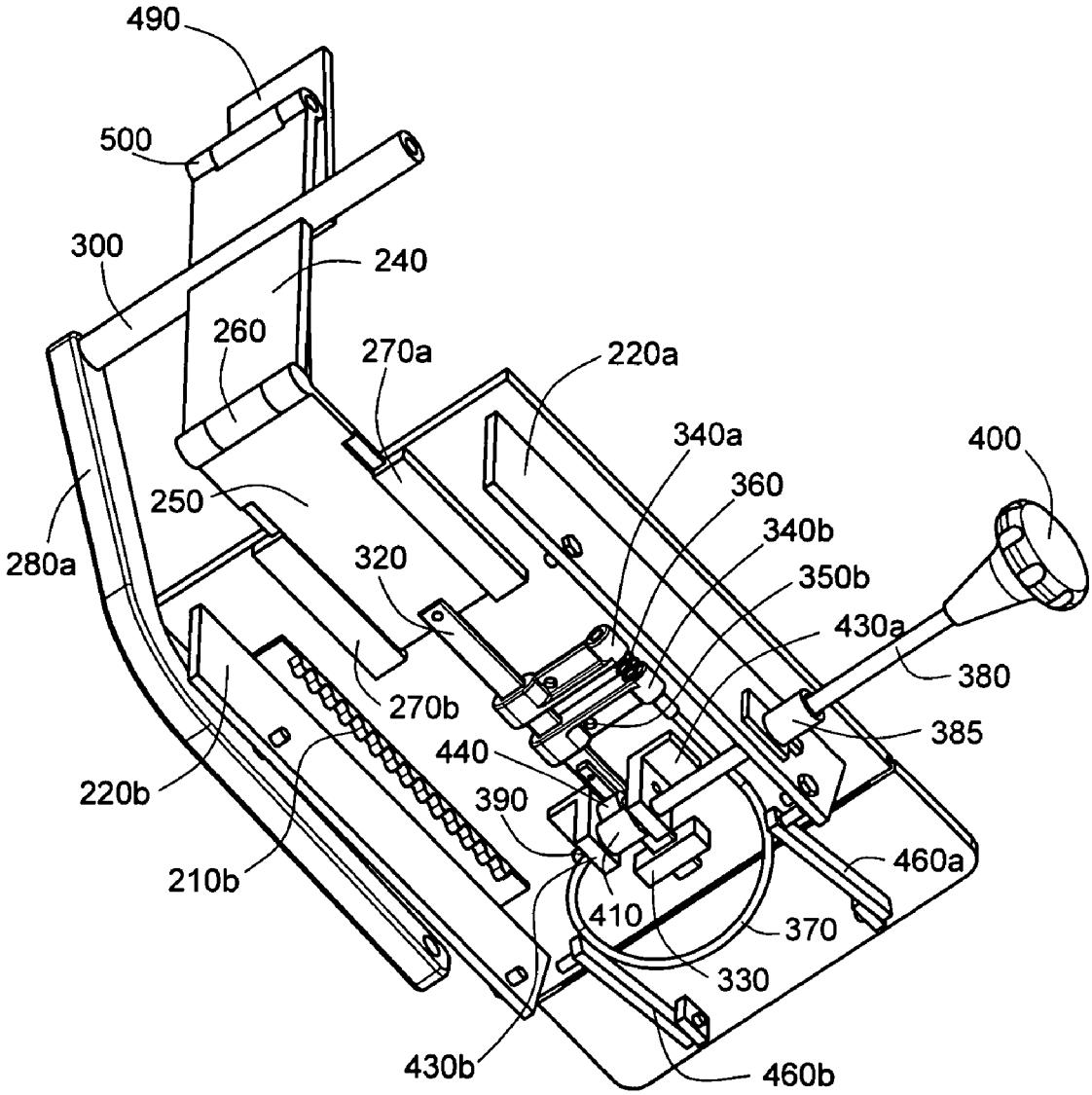
FIG. 12 is a lower right perspective view showing the angular variation control mechanism.

FIGS. 11 and 12 are detailed views showing the control elements for biasing the angular variation between the seat plate and the back support. Employing the control mechanism shown, the angular variation bias can be adjusted by activating the release cable 370, which is attached at one end to the rod locks and at the other end to a release sleeve 380 at point 390. Tension is applied to the release cable by turning a bias control knob 400 in either direction. A small initial turn activates a retraction screw inside the release sleeve which closes the rod locks and releases the angle rod. Turning the bias control knob further then imparts a rotational movement to a pinion gear 410 and idler gear 420, the combination of which are hung between brackets 430*a*, 430*b*, which are disposed on the underside of seat plate 200. The end result is a linear motion applied to the angle rod by the attached gear rack 440, which is integral or otherwise fixed to the angle rod 320. As will be appreciated, the control assembly and controls can be mounted on either side of the seating mechanism with no impact on function. The release sleeve can be protected and provided with structural reinforcement with a bushing or collar 385 mounted on the proximity plate.

The articulating seating mechanism of the present invention is also suited to connection to a dynamically tilting front edge, shown in all views except FIG. 8. When a user reclines in a typical office chair elevated for use at task, the front edge of the seat will lift the user's feet from the floor. Therefore, to address this ergonomic liability and source of physical discomfort, and in accordance with the present invention, a seat flap 450 is provided and hinged to the front side of the seat plate 200. Two connector links 460*a*, 460*b* are pivotally attached to brackets 470*a*, 470*b*, on the seat flap, and to connection points 480*a*, 480*b*, on the interior sides 172*a*, 172*b* of the right and left rails. As the seat plate tilts back the connector links pull the seat flap down. Where a seat cushion is attached to the seat plate, this motion is transferred to the cushion and bends the leading edge down, thereby releasing pressure under the user's thighs. Together with the back links 280*a*, 280*b*, the connector links also provide the primary attachment of the seat plate 200 to the rocker base 110.

A final dynamic element comprises a back strut 490 pivotally connected to back support 240 at a hinge 500 disposed on the upper end of back support 240. The lower end of back strut 490 has prongs 510 which are pivotally connected to a bar 520. The bar is provided with a gear rack or roller engaging surface depending on the type of control preferred. A pinion gear or tension roller housing 530 is mounted on the top side of seat plate 200 and includes a roller or pinion gear operable by turning of back strut adjustment knob 540, as is well known in the art.

It is well known in the art to provide means for adjusting the height of an ergonomic chair. The articulating seating mechanism of the present invention is sensitive to height, inasmuch as a higher seat elevation gives rise to higher pressures under a user's thighs, and therefore the more easily and rapidly the user comes to task from a reclined position. Likewise, the lower the seating height, the easier it is to remain in a more reclined position. Accordingly, it is preferably include height adjustment means in an office chair incorporating the inventive apparatus. Such a mechanism is shown in FIG. 8. In this view, height adjustment means comprise a thumb flange 550 radially disposed from a height adjustment sleeve 560. The height adjustment sleeve is concentrically and axially disposed on release sleeve 380, and operatively connected to a linkage 570. When the thumb flange is selectively moved, linkage 570 depresses extendable column release button 580 and the telescoping extendable center post of pedestal 22 is free to be moved up or down, as is well known in the art.

Thus, in a first aspect, and distilled to its essence, the present invention comprises an articulated seating mechanism including a rocker base, a seat plate, and a pair of side rails, each having an arcuate side. The side rails may be disposed downwardly from the seat plate or upwardly from the rocker base. An arcuate gear is disposed on the arcuate side of each of the side rails and linear gear racks are affixed either to the underside of the seat plate or the upper side of the rocker base, such that the linear gears and the arcuate gears are in an intermeshing relationship. A back support is pivotally connected to the seat plate and to first and second back links, and the back links are pivotally connected to the rocker base to provide a rocking motion of the seat plate and a dynamic synchronous adjustment of the angular variation between the seat plate and the back support. During rocking movements the linear gear racks move in a tangent to the arcuate gears to create a moving fulcrum.

Figure 13:
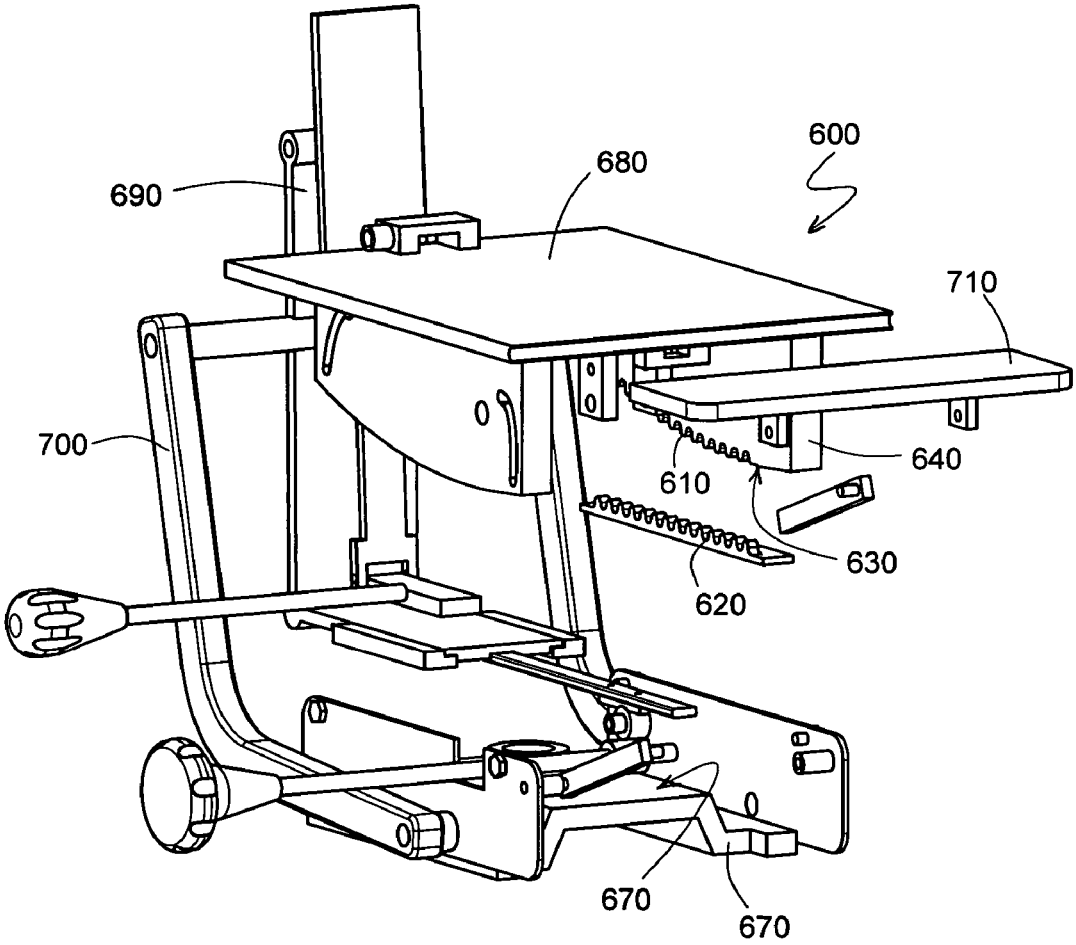
FIG. 13 is an exploded front right perspective view of a second preferred embodiment of the articulated seating mechanism of the present invention.
Figure 14:
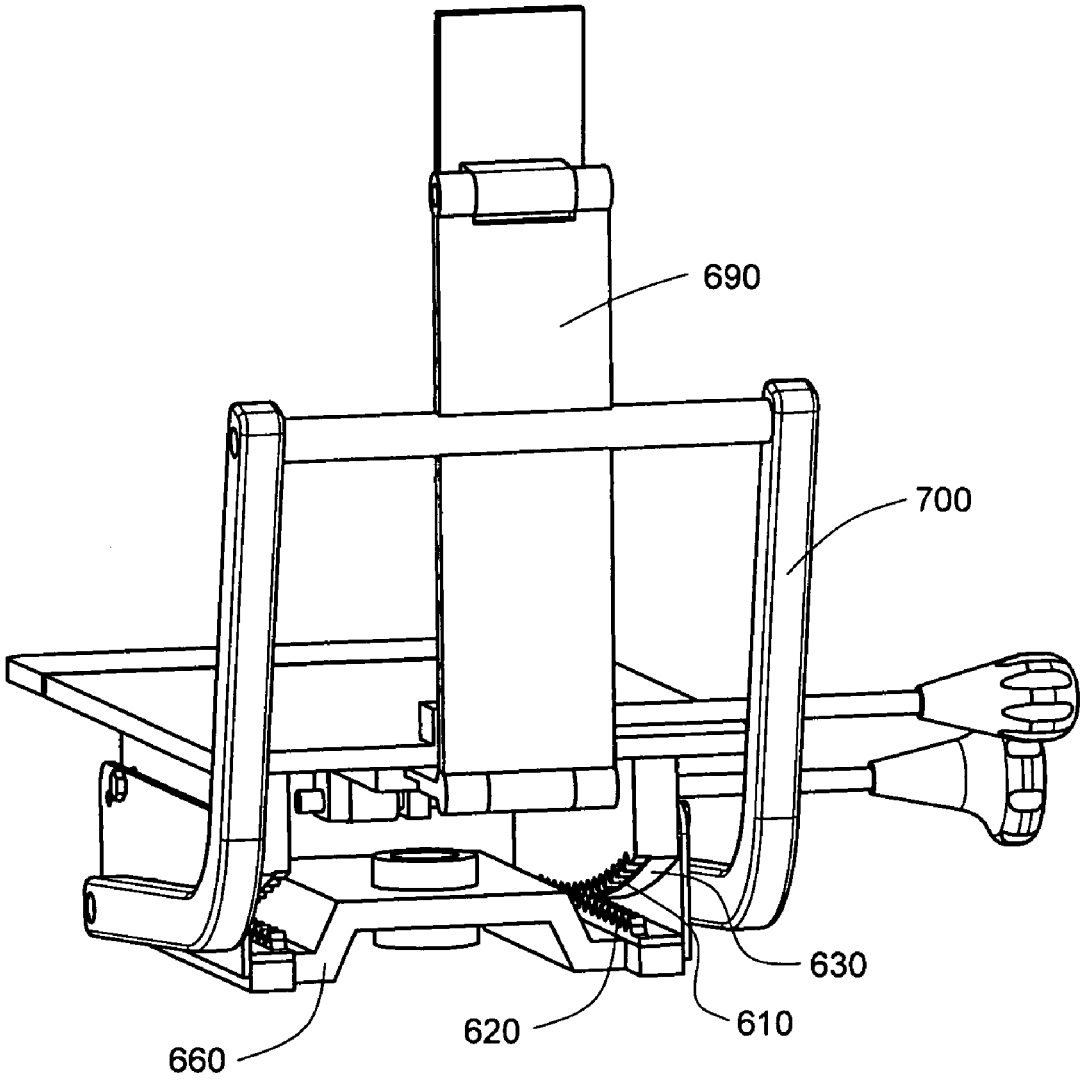
FIG. 14 is a left rear perspective view of the apparatus of FIG. 11.

FIGS. 13 and 14 illustrate a second preferred embodiment 600 of the articulated seating mechanism of the present invention. The physical and functional elements of this embodiment are identical to those in the first preferred embodiment, the exception being that the arcuate gear rack 610 and the linear gear rack 620 are inverted, the arcuate gear rack being disposed on the arcuate underside 630 of rails 640, and the linear gear rack 650 being affixed to an upper surface 660 of rocker base 670. Otherwise the structures are essentially identical to those in the first preferred embodiment, including, most importantly, seat plate 680, adjustable back support 690, pivotally connected back links 700, and seat flap 710.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An articulated seating mechanism, comprising:

a seat plate having a top side, a front side, a rear side, a right side, a left side, and an underside;

first and second linear gear racks;

a rocker base having an upper side;

first and second side rails, each of said side rails having an arcuate side;

first and second arcuate gear portions, each disposed on said arcuate side of one of said first and second side rails, said first and second arcuate gear portions in intermeshing relationship to said first and second linear gear racks, respectively;

a seat back pivotally connected to said seat plate;

first and second back links pivotally connected to said seat back and to said rocker base;

whereby during rocking movements of said seating mechanism, said first and second linear gear racks provide a moving tangent relative to said first and second arcuate gear portions such that said rocking movements occur over a moving fulcrum.

2. The seating mechanism of claim 1, wherein said side rails include a front side, a rear side, a top side, an underside, an interior side, an exterior side.

3. The seating mechanism of claim 1, wherein:

said first and second side rails are disposed upwardly from said upper side of said rocker base and include a top side;

said first and second arcuate gear portions are each disposed on one of said top sides of said first and second side rails; and said first and second linear gear racks are disposed on said underside of said seat plate.

4. The seating mechanism of claim 1, wherein each of said first and second side rails includes a substantially flat underside, an arcuate top side having an apex, a front side, a rear side, a width, an interior side, and an exterior side, wherein a rear portion arcs downwardly toward said rear side a front portion curves downwardly toward said front side; and wherein first and second arcuate gear portions have a width that is less than said width of said first and second side rails.

5. The seating mechanism of claim 4, wherein each of said first and second arcuate gear portions span at least said rear portion of said top side of one of said side rails from said apex to a point proximate said rear side, and at least one gear tooth forward from said apex toward said front side of said rail.

6. The seating mechanism of claim 4, wherein said first and second side rails include front and rear arcuate slots.

7. The seating mechanism of claim 6, further including first and second proximity plates, integral with and disposed downwardly from said underside of said seat plate so as to prevent lateral movement of said seat plate over said rocker base.

8. The seating mechanism of claim 7, wherein said first and second proximity plates include front and rear selectively removable pins, inserted into said front and rear slots of said first and second rails, whereby the movement of said selectively removable pins within said front and rear slots define the allowable range of rocking movement of said seat plate.

9. The seating mechanism of claim 1, further including opposing first and second slide rails affixed to said underside of said seat plate, and wherein seat back comprises a back support and a substantially planar back slide plate having a front portion and a rear portion, said back support pivotally connected to said rear portion of said back slide plate, said front portion of said back slide plate slidably and adjustably inserted between said first and second slide rails.

10. The seating mechanism of claim 1, wherein said seat back includes a transverse bar and wherein said first and second back links are arcuate and have a front end pivotally attached to one of said first and second side rails and a rear end pivotally attached to said transverse bar.

11. The seating mechanism of claim 10, further including biasing means for adjusting the angle between said seat plate and said rocker base is adjustable.

12. The seating mechanism of claim 11, wherein said biasing means moves said back slide plate relative to said seat plate.

13. The seating mechanism of claim 12, wherein said biasing means comprises:

an angle rod connected at one end to said front portion of said back slide plate and captured at another end by an angle rod guide which is affixed to said underside of said seat plate;

a pair of rod locks pivotally fastened to said underside of said seat plate at a pivot point, each of said rod locks having a slotted opening at a first end that accommodates said angle, and also having a second end;

a compression spring disposed between and urging said rod locks apart at said second end, thereby restricting said back slide plate and preventing rotational movement to said transverse bar;

a release cable terminating in a release sleeve operably connected to said second end of said rod locks, said release sleeve having a retraction screw;

a pinion gear and an idler gear combination, said combination hung between brackets disposed on said underside of said seat plate;

a bias control knob connected to said release cable for selectively activating said retraction screw to release tension on said compression spring and for engaging said pinion gear and idler gear combination to selectively apply a linear motion applied to said angle rod.

14. The seating mechanism of claim 1, further including a tilting front edge pivotally connected to said seat plate and responsive to any rocking motions of the seating mechanism such that as the mechanism is rocked backward, the front seat edge hinges and tilts downwardly, and as the seating mechanism is rocked forward, the front seat edge hinges and tilts upwardly.

15. The seating mechanism of claim 1, wherein said tilting front edge comprises a seat flap hinged to said front side of said seat plate, two connector links pivotally connected at one end to brackets affixed to said seat flap, and pivotally connected at another end to pivot points on said interior sides of said first and second rails, whereby as said seat plate is tilted back said connector links pull said seat flap down.

16. The seating mechanism of claim 1, further including a hub affixed to said underside of said seat plate for a swiveling connection to a center post of a chair pedestal.

17. The seating mechanism of claim 1, wherein said first and second side rails are disposed downwardly from said underside of said seat plate and include an arcuate underside.

18. The seating mechanism of claim 17, wherein said side rails include a front side, a rear side, a top side, an underside, an interior side, an exterior side, and wherein said first and second arcuate gear portions are each disposed on one of said undersides of said first and second side rails; and said first and second linear gear racks are disposed on said upper side of said rocker base.

* * * * *